US012503754B2

(12) United States Patent
Muller et al.

(10) Patent No.: US 12,503,754 B2
(45) Date of Patent: Dec. 23, 2025

(54) METHOD OF MAKING 6XXX ALUMINIUM SHEETS WITH HIGH SURFACE QUALITY

(71) Applicant: CONSTELLIUM NEUF-BRISACH, Biesheim (FR)

(72) Inventors: Estelle Muller, Grenoble (FR); Gilles Guiglionda, Seyssinet-Pariset (FR); Philipp Laboissiere, Colmar (FR); Laurent Ferry, Mittelwih (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 847 days.

(21) Appl. No.: 17/298,387

(22) PCT Filed: Dec. 4, 2019

(86) PCT No.: PCT/EP2019/083742
§ 371 (c)(1),
(2) Date: May 28, 2021

(87) PCT Pub. No.: WO2020/120267
PCT Pub. Date: Jun. 18, 2020

(65) Prior Publication Data

US 2021/0340654 A1 Nov. 4, 2021

(30) Foreign Application Priority Data

Dec. 11, 2018 (EP) ..... 18211790

(51) Int. Cl.
*C22F 1/043* (2006.01)
*C22C 21/02* (2006.01)

(52) U.S. Cl.
CPC ..... *C22F 1/043* (2013.01); *C22C 21/02* (2013.01)

(58) Field of Classification Search
CPC ..... C22F 1/043
See application file for complete search history.

(56) References Cited

U.S. PATENT DOCUMENTS 6,652,678 B1 * 11/2003 Marshall ..... C22C 21/02 148/695
2010/0140979 A1 * 6/2010 Seksaria ..... B62D 29/002 296/193.11
2012/0234437 A1 9/2012 Bassi et al.
2016/0201158 A1 * 7/2016 Kamat ..... C21D 1/18 296/191
2019/0119800 A1 * 4/2019 Yamamoto ..... C22C 21/18

FOREIGN PATENT DOCUMENTS

| | | | | |
|---|---|---|---|---|
| EP | 0786535 | A1 | 7/1997 | |
| EP | 1375691 | A9 | 6/2004 | |
| EP | 2121419 | A2 | 11/2009 | |
| EP | 2328748 | A1 | 6/2011 | |
| JP | 2823797 | B2 | 11/1998 | |
| JP | 3590685 | B2 | 11/2004 | |
| JP | 2005290431 | A * | 10/2005 | |
| JP | 2009263781 | A | 11/2009 | |
| JP | 2010242215 | A | 10/2010 | |
| JP | 2012077318 | A | 4/2012 | |
| JP | 2015067857 | A | 4/2015 | |
| JP | 6208389 | B1 * | 10/2017 | ..... B21B 1/36 |
| WO | 2006056481 | A1 | 6/2006 | |
| WO | 2014135367 | A1 | 9/2014 | |
| WO | 2018033537 | A2 | 2/2018 | |

OTHER PUBLICATIONS

English machine translation of JP 2005-290431 A retrieved on Feb. 3, 2024 (Year: 2005).*
International Search Report of International Patent Application No. PCT/EP2019/083742, mailed Mar. 17, 2020.
Guillotin et al., "Quantification of roping intensity on aluminium sheets by Areal Power Spectral Density analysis", Materials Characterization, Nov. 2010, pp. 1119-1125, vol. 61.
VDA (Verband Der Automobilindustrie, German Association of the Automotive Industry) Recommendation 239-400, Jul. 2017.

* cited by examiner

*Primary Examiner* — Jophy S. Koshy
*Assistant Examiner* — Joshua S Carpenter
(74) *Attorney, Agent, or Firm* — McBee Moore & Vanik IP, LLC

(57) ABSTRACT

The invention is directed to a method for producing a 6xxx series aluminium sheet comprising the steps of homogenizing an ingot made from a 6XXX series aluminium alloy comprising in wt. % Si: 0.4-0.7, Mg: 0.2-0.4, Mn: 0.05-0.30, Fe: 0.03 to 0.4, Cu up to 0.3, Cr up to 0.05, Zn up to 0.15, Ti up to 0.1 wt %, rest aluminium and unavoidable impurities up to 0.05 each and 0.15 total, rough hot rolling on a reversible mill to a rough hot rolling exit thickness with a rough hot rolling exit temperature less than 420° C., finish hot rolling the ingot to a hot rolling final thickness with a tandem mill and coiling at the hot rolling final thickness with a hot rolling exit temperature less than 300° C., cold rolling to obtain a cold rolled sheet.

20 Claims, No Drawings

METHOD OF MAKING 6XXX ALUMINIUM SHEETS WITH HIGH SURFACE QUALITY

CROSS-REFERENCE TO RELATED APPLICATIONS

This application is the National Stage entry of International Application No. PCT/EP2019/083742, filed 4 Dec. 2019, which claims priority to European Patent Application No. 18211790.3, filed 11 Dec. 2018.

BACKGROUND

Field

The present invention relates to a method of making 6XXX series aluminium sheet, particularly useful for the automotive industry.

Description of Related Art

Usually an automotive component such as a car hood is mainly made of two parts: an outer part and an inner part. The first is visible from outside the car and the second is not visible unless for example in case of opening of the hood.

The components need to encompass many requirements among which there are the pedestrian safety and the quality of the surface for painting performance. Therefore, the outer part is usually developed to have a high painting aspect quality. The inner part or automobile hood inner is usually not subjected to the same requirements regarding painting aspect quality. The inner part is usually developed in view of pedestrian safety in case of collision.

Various aluminium alloys are used in the form of sheets or blanks for automotive usages. Among these alloys, AA6xxx aluminium alloys series, such as AA6016-T4 are known to combine interesting chemical and mechanical properties such as hardness, strength, forming and even corrosion resistance. The requirement of high painting aspect quality for outer part means for example that the part does not have objectionable and/or deleterious surface defects referred to as roping, or paint brush lines, which appear on the surface of stamped or formed aluminium sheet components. The roping lines appear in the rolling direction only upon application of sufficient transverse strain, such as that occurring in typical stamping or forming operations. New criteria for surface quality have recently appeared based on analysis of digitized images, including any directional surface roughening which are relevant for the final product aspect. This type of method has been for example explained by A. Guillotin et al. (MATERIALS CHARACTERIZATION 61 (2010) 1119-1125) or VDA (Verband Der Automobilindustrie, German Association of the Automotive Industry) Recommendation 239-400, July 2017. These properties generally make AA6xxx aluminium alloys a material of choice in the automotive industry. In order to face the constant increase of applications of these sheets and the required surface quality in the automotive industry, it is needed to improve the speed of the method of making such products for a given surface quality requested by the customers. Indeed, current method including several heat treatments have proved to be efficient for surface quality and formability but may be long and expensive.

Several initiatives aiming at improving roping resistance of the outer parts in relation with appearance quality after forming have also been reported. According to these, the occurrence of roping is related to the recrystallization behavior of the material. And as a measure to restrain the occurrence of roping, it has been proposed to control recrystallization at the stage of sheet production by means of the hot rolling or the like that is carried out after homogenization of the alloy ingot.

The patent application EP1375691 A9 describes a method for producing a rolled sheet of a 6000 type aluminium alloy containing Si and Mg as main alloy components, which comprises subjecting an ingot to a homogenization treatment, cooling to a temperature lower than 350° C. at a cooling rate of 100° C./hr or more, optionally to room temperature, heating again to a temperature of 300 to 500° C. and subjecting it to hot rolling, cold rolling the hot rolled product, and subjecting the cold rolled sheet to a solution treatment at a temperature of 400° C. or higher, followed by quenching. The strength of the products is however again too high for certain parts with specific requirements for pedestrian safety.

The patent application US2016/0201158 describes a method of producing a 6xxx series aluminium sheet, comprising: casting a 6xxx series aluminium alloy to form an ingot; homogenizing the ingot; hot rolling the ingot to produce a hot rolled intermediate product, followed by: a) after exit temperature coiling, immediately placing into an anneal furnace, or b) after exit temperature coiling, cooling to room temperature and then placing into an anneal furnace; annealing; cold rolling; and subjecting the sheet to a continuous anneal and solution heat treatment process. The strength of the products is however too high for certain parts with specific requirements for pedestrian safety.

The patent application EP0786535 A1 describes a method wherein an aluminium alloy ingot containing not less than 0.4% by weight and less than 1.7% by weight of Si, not less than 0.2% by weight and less than 1.2% by weight of Mg, and Al and unavoidable impurities for the remainder is homogenized at a temperature of not lower than 500° C.; the resultant product being cooled from a temperature of not lower than 500° C. to a temperature in the range of 350-450° C. and started to be hot rolled; the hot rolling step being finished at a temperature in the range of 200-300° C.; the resultant product being subjected to cold rolling at a reduction ratio of not less than 50% immediately before it has been solution-treated; the cold rolled product being then solution-treated in which it is retained at a temperature in the range of 500-580° C. at a temperature increasing rate of not less than 2° C./s for not more than 10 minutes; the resultant product being subjected to hardening in which it is cooled to a temperature of not higher than 100° C. at a cooling rate of not less than 5° C./s. The strength of the products is however again too high for certain parts with specific requirements for pedestrian safety.

As practical measures of such roping resistance improvement, the patents JP2823797 and JP3590685 restrain the crystal grain from coarsening during hot rolling by chiefly setting the starting temperature of hot rolling to a relatively low temperature of 450° C. or less, and seek to control the material structure after the subsequent cold working and solution treatment. Patent application JP2009-263781 recites implementing different circumferential speed rolling in warm areas and different circumferential speed rolling in the cold areas after hot rolling. Here, patent JP3590685 and patent applications JP2012-77318 and JP2010-242215 propose to perform intermediate annealing after hot rolling, or to perform intermediate annealing after briefly carrying out cold rolling.

The patent application JP2015-67857 describes a manufacturing method of Al—Mg—Si-based aluminium alloy sheet for automobile panel that is characterized by the following: an ingot is prepared that comprises Si: 0.4~1.5 wt. %, Mg: 0.2~1.2 wt. %, Cu: 0.001~1.0 wt. %, Zn: 0.5 wt. % or less, Ti: than 0.1 wt. %, B: 50 ppm or less, as well as one or more than two of the following Mn: 0.30 wt. % or less, Cr: 0.20 wt. % or less, Zr: 0.15% or less, balance being Al and inevitable impurities, the said ingot goes through homogenization treatment at a temperature above 450° C., it is cooled to less than 350° C. at a cooling rate of over 100° C./hour, and is once again reheated at a temperature between 380° C.~500° C., and hot rolling is conducted to initiate the rolling process, and plate with thickness of 4~20 mm is created, and the said plate goes through cold reduction so that its plate thickness reduction rate is over 20% and the plate thickness is greater than 2 mm, and goes through intermediate annealing at a temperature between 350~580° C., and goes through further cold reduction, and then after it goes through a solution treatment at a temperature range of 450~600° C., it is rapidly cooled to a temperature that is less than 150° C. at an average cooling speed of over 100° C./minute, and is heat processed within 60 minutes after the rapid cooling process so that it stays within 40~120° C. for 10 to 500 minutes.

Specific products usually for inner parts without requirements of surface quality have also been developed for improved pedestrian safety.

Patent application WO2006/056481 discloses an aluminium alloy sheet for automotive applications for improved pedestrian safety, having a chemical composition in weight percent: 0.80≤Si≤1.20–0.10≤Fe≤0.30–0.05≤Mn≤0.20–0.10≤Mg≤0.30–Cu≤0.30–Ti≤0.15–other elements up to 0.05 each, up to 0.15 in total Al balance, in T4 temper condition having a yield strength (Rp) of at least 50 MPa, a uniform elongation (Au) of at least 20% and a total elongation (A80) of at least 22%.

Patent application WO2018/033537 discloses an aluminum alloy for vehicle applications with a moderate strength level, the produced strip showing only a low tendency for curing from the state T4 than can be used for pedestrian impact. The aluminum alloy has the following alloying constituents (in percent by weight): 0.4 wt. %≤Si≤0.55 wt. %, 0.15 wt. %≤Fe≤0.25 wt. %, Cu≤0.06 wt. %, 0.15 wt. %≤Mn≤0.4 wt. %, 0.33 wt. %≤Mg≤0.4 wt. %, Cr≤0.03 wt. %, 0.01 wt. %≤Ti≤0.10 wt. %, the remainder Al and unavoidable impurities of at most 0.05 wt. % individually and at most 0.15 wt. % in total.

The patent application US20120234437 discloses a car component with at least one first component of sheet metal of a first aluminum alloy and at least one second component of sheet metal of a second aluminum alloy, the first and second aluminum alloys are of type AlMgSi and in the sheet metal of the second aluminum alloy a substantial part of the elements Mg and Si, which are required to achieve artificial ageing in solid solution, is present in the form of separate Mg2Si and/or Si particles in order to avoid artificial ageing.

Other approaches to improve pedestrian safety have been to provide clad sheets or other types of composite products.

The patent application EP2328748 relates to an automotive clad sheet product comprising a core layer and at least one clad layer wherein the core comprises an alloy of the following composition in weight %: Mg 0.45-0.8, Si 0.45-0.7, Cu 0.05-0.25, Mn 0.05-0.2, Fe up to 0.35, other elements (or impurities)<0.05 each and <0.15 in total, balance aluminium; and the at least one clad layer comprises an alloy of the following composition in weight %: Mg 0.3-0.7, Si 0.3-0.7, Mn up to 0.15, Fe up to 0.35, other elements (impurities) <0.05 each and <0.15 in total, balance aluminium. However clad products are usually expensive and monolithic products (not cladded) are preferable.

The patent application EP2121419 provides a thin vehicle closure panel design that substantially reduces a thickness of a vehicle hood and the impact effect on the head of a pedestrian struck by a motor vehicle by incorporating a foam core positioned between and bonded to the outer and/or the inner panel of the hood shell.

An inner component for hood having a painting surface quality of the outer material is a request of some high-end car makers. A careful balance for the inner component material between the different criteria: sufficient controlled strength for the car mechanical properties and pedestrian safety as well as sufficient surface quality is then sought.

There is thus a need in the automotive industry for an improved monolithic aluminium sheet product which combines careful balance between different criteria: controlled strength for the car mechanical properties and pedestrian safety as well as sufficient surface quality. Indeed, for some products such as visible inner parts of the hood, surface quality is required and roping is to be avoided together with high pedestrian safety performance.

SUMMARY OF THE INVENTION

A first object of the invention is a method for producing a 6xxx series aluminium sheet comprising the steps of:

- homogenizing an ingot made from a 6XXX series aluminium alloy comprising in wt. %
  - Si: 0.4-0.7,
  - Mg: 0.2-0.4,
  - Mn: 0.05-0.30,
  - Fe: 0.03 to 0.4,
  - Cu up to 0.3,
  - Cr up to 0.05,
  - Zn up to 0.15,
  - Ti up to 0.1 wt %,
  - rest aluminium and unavoidable impurities up to 0.05 each and 0.15 total,
- rough hot rolling on a reversible mill to a rough hot rolling exit thickness with a rough hot rolling exit temperature less than 420° C.,
- finish hot rolling the ingot to a hot rolling final thickness with a tandem mill and coiling at the hot rolling final thickness with a hot rolling exit temperature less than 300° C.,
- cold rolling to obtain a cold rolled sheet.

Another object of the invention is a 6xxx series aluminium sheet obtainable by a method of the invention having a roping value "RK" according to VDA Recommendation 239-400 of less than 5.0 and a TYS in the LT direction after bake hardening, TYS(LT)BH between 90 MPa and 150 MPa.

Still another object of the invention is the use of a 6xxx series aluminium sheet according to the invention as an automobile hood inner.

DESCRIPTION OF THE INVENTION

All aluminium alloys referred to in the following are designated using the rules and designations defined by the Aluminium Association in Registration Record Series that it publishes regularly, unless mentioned otherwise.

Metallurgical tempers referred to are designated using the European standard EN-515.

All the alloy compositions are provided in weight % (wt. %).

The inventors have found a method to make improved 6xxx aluminium alloy sheets which combine careful balance between different criteria: controlled strength for the car mechanical properties and pedestrian safety as well as sufficient surface quality. The products obtained by the method of the invention are monolithic and combine high pedestrian safety properties and high surface quality.

According to the invention, an ingot is prepared by casting, typically Direct-Chill casting, using 6xxx series aluminium alloys. The ingot thickness is preferably at least 250 mm, or at least 350 mm and preferentially a very thick gauge ingot with a thickness of at least 400 mm, or even at least 500 mm or 600 mm in order to improve the productivity of the process. Preferably the ingot is from 1000 to 2000 mm in width and 2000 to 8000 mm in length.

The Si content is from 0.4 wt. % to 0.7 wt. % and preferably from 0.40 wt. % to 0.70 wt. %.

Si is an alloying element that forms the base of the alloy series of the present invention and, together with Mg, contributes to strength improvement. When the Si content is under 0.4 wt. % the aforementioned effect may be insufficient, while a content exceeding 0.7 wt. % may result in a strength detrimental to pedestrian safety. Minimum Si content of 0.50 wt. %, or 0.52 wt. % or 0.55 wt. % are be advantageous. Maximum Si content of 0.68 wt. %, or 0.65 wt. % may be advantageous.

The Mg content is from 0.2 wt. % to 0.4 wt. % and preferably from 0.20 wt. % to 0.40 wt. %.

Mg is also an alloying element that forms the base of the alloy series that is the target of the present invention and, together with Si, contributes to strength improvement. When the Mg content is under 0.2% wt. %, strength improvement may be insufficient.

On the other hand, a content exceeding 0.4 wt. % may result in a strength detrimental to pedestrian safety. Minimum Mg content of 0.23 wt. %, or 0.25 wt. % or 0.27 wt. % may be advantageous. Maximum Mg content of 0.37 wt. %, or 0.35 wt. % or 0.33 wt. % may be advantageous.

There are some advantageous combinations of Si and Mg contents. In one embodiment, the Si content is between 0.55 wt. % and 0.60 wt. % and the Mg content is between 0.25 wt. % and 0.30 wt. %. With this embodiment a very high surface quality with moderate strength may be obtained. In another embodiment the Si content is between 0.60 wt. % and 0.65 wt. % and the Mg content is between 0.30 wt. % and 0.35 wt. %. With this embodiment, the strength is higher and the surface quality is still acceptable.

The process parameters of the present invention which enable a high surface quality have been defined for a Cu content of at most 0.3 wt. %. Preferably the Cu content is between 0.08 wt. % and 0.25 wt. %, as the presence of Cu in solid solution improves work hardening and is favourable for formability. A more preferred maximum Cu content is 0.15 wt. %. In an embodiment the Cu content is from 0.08 to 0.15 wt. % and/or the Si content is from 0.55 to 0.65 wt. %.

Mn is an effective element for strength improvement, crystal grain refining and structure stabilization. When the Mn content is under 0.05 wt. %, the aforementioned effect is insufficient.

On the other hand, a Mn content exceeding 0.3 wt. % may not only cause a saturation of the above effect but also cause the generation of multiple intermetallic compounds that could have an adverse effect on formability. Consequently, the Mn content is set within a range of 0.05-0.3 wt. %. Preferentially the Mn content is set within a range of 0.10-0.25 wt. % and more preferably within a range 0.15-0.20 wt. %.

The Cr content is up to 0.05 wt. %. In an embodiment some Cr may be added for strength improvement, crystal grain refining and structure stabilization with a content between 0.01 wt. % and 0.04 wt. %. In another embodiment the Cr content is less than 0.01 wt. %.

Fe is also an effective element for strength improvement and crystal grain refining. A Fe content under 0.03 wt. % may not produce a sufficient effect while, on the other hand, a Fe content exceeding 0.4 wt. % may cause the generation of multiple intermetallic compounds that could make bending workability drop. Consequently, the Fe content is set within a range of 0.03 wt. % to 0.4 wt. % and preferably 0.1 wt. % to 0.3 wt. %. In an embodiment the Fe content is set within a range of 0.20 wt. % to 0.30 wt. %

Zn may be added up to 0.15 wt. % and preferably up to 0.10 wt. % without departing from the advantages of the invention. In an embodiment Zn is among the unavoidable impurities.

Grain refiners comprising Ti are typically added with a total Ti content of up to 0.1 wt. % and preferably between 0.01 and 0.05 wt. %.

The rest is aluminium and unavoidable impurities up to 0.05 wt. % each and 0.15 wt. % total.

The ingot is then homogenised typically at a temperature between 500° C. and 560° C., preferably at a temperature between 510° C. and 550° C. and more preferably between 520° C. and 540° C., typically for a period of 0.5 to 24 hours, for example during at least 2 hours and preferably during at least 4 hours. Homogenization may be carried out in one stage or several stages of increasing temperature, in order to avoid incipient melting.

After homogenization, the ingot is hot rolled. The homogenized ingot may be cooled to room temperature and reheated to the hot rolling temperature. In an advantageous embodiment the homogenized ingot is cooled with a cooling rate in a range from 150° C./h to 2000° C./h directly to the hot rolling starting temperature, preferably, the cooling rate being of at least 200° C./h, preferably at least 250° C./h and preferentially at least 300° C./h and at most 1500° C./h, or preferably at most 1000° C./h or more preferably at most 500° C./h. The preferred cooling rate is obtained at mid-thickness and/or at quarter thickness of the ingot and/or on average of the ingot, typically between the homogenizing temperature and the hot rolling temperature and preferably in the temperature range between 500° C. and the hot rolling temperature. A device such as the cooling facility disclosed in patent application WO2016/012691, which is enclosed by reference in its entirety, and the method described therein are suitable for cooling the ingot. When the ingot thickness is at least 250 mm or at least 350 mm and preferentially, at least 400 mm, or even at least 500 mm or 600 mm and wherein preferably the ingot is from 1000 to 2000 mm in width and 2000 to 8000 mm in length, it is advantageous that a thermal differential of less than 40° C. and preferentially of less than 30° C. over the entire ingot cooled from the homogenization temperature is obtained at the hot rolling starting temperature, when hot rolling is started. If a thermal differential of less than 40° C. or preferably less than 30° C. is not obtained, the desired hot rolling starting temperatures may not be obtained locally in the ingot and the desired surface quality and mechanical properties may not be obtained.

After homogenization and/or reheating, said ingot is hot-rolled in two successive steps in order to obtain a sheet with a first hot rolling step on a reversible rolling mill also known as roughing mill up to a thickness of between 12 and 40 mm and a second hot rolling step on a tandem mill also known as finishing mill up to a thickness of between 3 and 12 mm. A tandem mill is a rolling mill in which several cages supporting rolling mill rolls, typically 2, 3, 4 or 5 act successively ("in tandem").

According to the invention rough hot rolling on the reversible mill is done with a rough hot rolling exit temperature less than 420° C. The present inventors have observed that unexpectedly if the rough hot rolling exit temperature is 420° C. or more, the surface quality is decreased. Preferably the rough hot rolling exit temperature is at most 410° C., or at most 405° C. or at most 400° C., or at most 395° C., or at most 390° C., or at most 385° C. Advantageously the rough hot rolling exit temperature is at least 360° C., or at least 365° C. or at least 370° C., or at least 375° C. Advantageously, the hot rolling starting temperature which is the starting temperature during the first hot rolling step is between 370° C. and 490° C. The first step on a reversible mill can be carried out on one or even two reversible mills placed successively. There are mainly four embodiments to obtain the desired rough hot rolling exit temperature. In a first embodiment, the ingot is heated to the homogenization temperature and rapidly cooled to a hot rolling starting temperature of between 370° C. and 430° C. and preferably between 380° C. and 400° C. with a cooling rate in a range from 150° C./h to 2000° C./h as previously described. In a second embodiment the ingot is heated to the homogenization temperature and rapidly cooled, to a hot rolling starting temperature of between 430° C. and 490° C. with a cooling rate in a range from 150° C./h to 2000° C./h as previously described, then the hot rolling passes are adapted to obtain the desired exit temperature. This second embodiment provides usually a lower productivity. In a third embodiment, the ingot is hot rolled with a hot rolling starting temperature substantially identical to the homogenizing temperature then the hot rolling passes are adapted to obtain the desired exit temperature. This third embodiment also provides usually a lower productivity. In a fourth embodiment the ingot is cooled to room temperature after homogenization and reheated to a hot rolling starting temperature of between 370° C. and 430° C. and preferably between 380° C. and 400° C. This fourth embodiment has the drawback to heat twice the ingot.

In the second hot rolling step the final temperature which is the hot rolling exit temperature should be less than 300° C., so that preferably the hot rolled sheet obtained after finish hot rolling exhibit at most 50% recrystallization rate. Advantageously, the final temperature during the second hot rolling step is between 280° C. and 300° C.

Cold rolling is realized directly after the hot rolling step to further reduce the thickness of the aluminium sheets. With the method of the invention annealing and/or solution heat treatment after hot rolling or during cold rolling is not necessary to obtain sufficient strength, formability, surface quality and corrosion resistance. Preferably no annealing and/or solution heat treatment after hot rolling or during cold rolling is carried out. The sheet directly obtained after cold rolling is referred to as the cold rolled sheet. The cold rolled sheet thickness is typically between 0.5 and 2 mm and preferably between 0.8 and 1.2 mm.

In an embodiment, the cold rolling reduction is at least 40%, or at least 50% or at least 60%. Typically the cold rolling reduction is at about 70%.

Advantageous embodiments of cold rolling reduction may enable to obtain improved mechanical properties and/or to obtain an advantageous grain size for surface properties such as surface quality.

After cold rolling, the cold rolled sheet is advantageously further solution heat treated and quenched in a continuous annealing line. Preferably the continuous annealing line is operated in such a way that a temperature of at least 460° C., preferably at least 500° C., or 520° C. or even 530° C. is reached by the sheet, most preferably between 540° C. and 560° C.

Typically, the continuous annealing line is operated such that the heating rate of the sheet is at least 10° C./s for metal temperature above 400° C., the time above 520° C. is between 5 s and 25 s and the quenching rate is at least 10° C./s, preferably at least 15° C./s for 0.8 to 1.2 mm gauge. The coiling temperature after solution heat treatment is preferably up to 85° C., preferably up to 65° C. and more preferably between 45° C. and 65° C.

After solution heat treatment and quench the sheet may be aged to a T4 temper and cut and formed to its final shape, painted and bake hardened.

The 6xxx series aluminium sheets obtained by the method of the invention are recrystallized and have a roping value "RK" according to VDA Recommendation 239-400 of less than 5.0 and a TYS in the LT direction after bake hardening (2% stretching and 20 min at 185° C.), referred to as $TYS(LT)_{BH}$, between 90 MPa and 150 MPa and preferably between 100 MPa and 140 MPa.

In the T4 temper the products of the invention have preferably a TYS in the LT direction, referred to as $TYS(LT)_{T4}$, between 50 MPa and 100 MPa and preferably between 65 MPa and 95 MPa.

In an embodiment, the sheets of the invention have a Si content between 0.55 wt. % and 0.60 wt. % a Mg content is 0.25 wt. % and 0.30 wt. %, a roping value "RK" according to VDA Recommendation 239-400 of less than 5.0 and preferably less than 4.0 and a TYS in the LT direction after bake hardening (2% stretching and 20 min at 185° C.), referred to as $TYS(LT)_{BH}$, between 90 MPa and 120 MPa. In another embodiment the sheets of the invention have a Si content between 0.60 wt. % and 0.65 wt. %, a Mg content between 0.30 wt. % and 0.35 wt. %, a roping value "RK" according to VDA Recommendation 239-400 of less than 5.0 and a TYS in the LT direction after bake hardening (2% stretching and 20 min at 185° C.), referred to as $TYS(LT)_{BH}$, between 120 MPa and 150 MPa.

The use of the 6xxx series aluminium sheets according to the invention for automobile manufacturing is advantageous. In particular the use of the sheets according to the invention as an automobile hood inner is advantageous.

Example

In this example six ingots with a cross section of at least 1780×520 mm made of an alloy having the composition disclosed in Table 1 were cast. A typical AA6016 alloy was also compared as reference G and transformed according to similar conditions as Ingot A.

TABLE 1

| Composition of the ingots | | | | | | | | |
|---|---|---|---|---|---|---|---|---|
| Ingot | Si | Fe | Cu | Mn | Mg | Cr | Zn | Ti |
| A | 0.57 | 0.24 | 0.09 | 0.17 | 0.28 | 0.02 | 0.01 | 0.02 |
| B | 0.57 | 0.23 | 0.09 | 0.17 | 0.28 | 0.02 | 0.01 | 0.02 |
| C | 0.56 | 0.24 | 0.09 | 0.17 | 0.29 | 0.02 | 0.01 | 0.02 |
| D | 0.62 | 0.25 | 0.10 | 0.18 | 0.32 | 0.02 | 0.02 | 0.02 |
| E | 0.61 | 0.24 | 0.09 | 0.17 | 0.33 | 0.02 | 0.02 | 0.02 |
| F | 0.63 | 0.25 | 0.09 | 0.18 | 0.34 | 0.02 | 0.01 | 0.02 |

The ingots were homogenized at the temperature of 530° C. during 2 hours. After homogenizing, the ingots were cooled down with a cooling rate at mid-thickness of 300° C./h directly to the hot rolling starting temperature. A thermal differential of less than 30° C. over the entire ingot cooled from the homogenization temperature was obtained. When this thermal differential was reached, hot rolling was started without wait. A device as described in patent application WO2016/012691 was used to cool down the ingots after homogenizing and obtain a thermal differential of less than 30° C. over the entire ingot cooled from its homogenization temperature.

The ingots were hot rolled with the conditions disclosed in Table 2. The hot rolling mill consisted of a rough reversing mill and a 4 stands finishing tandem mill.

TABLE 2

| Hot rolling parameters | | | | | |
|---|---|---|---|---|---|
| Ingot | Rough Hot rolling starting temperature [° C.] | Rough Hot rolling exit temperature [° C.] | Finish Hot rolling exit temperature [° C.] | Final thickness after hot rolling (mm) | Final thickness after cold rolling (mm) |
| A | 523 | 469 | 308 | 3.9 | 1.0 |
| B | 471 | 393 | 294 | 3.9 | 1.0 |
| C | 391 | 382 | 290 | 2.4 | 0.9 |
| D | 390 | 379 | 290 | 2.8 | 0.8 |
| E | 400 | 377 | 282 | 2.8 | 0.9 |
| F | 385 | 390 | 296 | 2.8 | 0.9 |

The recrystallization rate of the hot rolled strips after hot rolling was less than 50%.

The strips were further cold rolled to sheets with a final thickness of 0.8 to 1.0 mm. The sheets were solution heat treated, at 550° C. and quenched in a continuous annealing line.

The surface quality was measured according to VDA Recommendation 239-400. In particular, the sheet sample were plastically pre-strained 10%, transverse to the rolling direction. The surfaces were cleaned and a replica of the pre-strained surface was created by moistening the surface with water, applying a tape, removing the air bubbles and the water located under the tape, drying the tape with a soft cloth, grinding the tape by moving a grinding tool with a constant pressure back and forth 2 times transverse to the rolling direction, removing the replica from the surface and carryover on a black background, removing the air bubbles and the water, drying the tape with a cloth. The replicas were scanned. The scan resolution was 300 dpi in "shades of grey". The evaluation and the determination of the surface quality "Roping value RK" was performed according to the instructions and Macro described in VDA Recommendation 239-400. A low RK value corresponds to a high surface quality.

The RK values are presented in Table 3.

TABLE 3

| RK values | |
|---|---|
| Ingot | RK |
| A | 5.4 |
| B | 3.6 |
| C | 3.7 |
| D | 4.6 |
| E | 4.3 |
| F | 4.4 |
| G | 5.5 |

The surface quality of ingot B to F according to the invention was much improved compared to reference ingot A.

The 0.2% tensile yield strength, TYS, and ultimate tensile strength, UTS, of the T4 (after 6 days of natural ageing) and bake hardened sheets (2% stretching and 20 min at 185° C.) from those T4 aged sheets were determined in the transverse direction using methods known to one of ordinary skill in the art. The tensile tests were performed according to ISO/DIS 6892-1. The results are provided in Table 4.

TABLE 4

| Mechanical properties | | | | | | | |
|---|---|---|---|---|---|---|---|
| | T4 | | | | Bake hardened | | |
| | TYS LT (MPa) | UTS LT (MPa) | A80 (%) | Ag (%) | TYS LT (MPa) | UTS LT (MPa) | A80 (%) |
| A | 68 | 144 | 29.6 | 24.2 | 100 | 161 | 20.5 |
| B | 64 | 143 | 27.4 | 24.5 | 102 | 163 | 19.0 |
| C | 68 | 147 | 27.8 | 23.8 | 106 | 166 | 21.2 |
| D | 70 | 160 | 24.1 | 19.6 | 136 | 194 | 17.2 |
| E | 68 | 152 | 30.4 | 27.2 | 120 | 177 | 14.7 |
| F | 70 | 157 | 25.8 | 22.2 | 131 | 191 | 15.3 |
| G | 92 | 195 | 25.0 | 21.0 | 180 | 260 | 17.0 |

The products according to the invention, B to F, have a roping value "RK" according to VDA Recommendation 239-400 of less than 5.0 and a TYS in the LT direction after bake hardening (2% stretching and 20 min at 185° C.), between 90 MPa and 150 MPa.

The invention claimed is:

1. A method for producing a 6xxx series aluminum cold rolled sheet comprising homogenizing an ingot made from a 6XXX series aluminum alloy comprising in wt. %

Si: 0.4-0.7,

Mg: 0.2-0.4,

Mn: 0.05-0.30,

Fe: 0.03 to 0.4,

Cu up to 0.3,

Cr up to 0.05,

Zn up to 0.15,

Ti up to 0.1, rest aluminum and unavoidable impurities up to 0.05 each and 0.15 total, rough hot rolling the homogenized ingot on a reversible mill to a rough hot rolling exit thickness with a rough hot rolling exit temperature less than 420° C., finish hot rolling the homogenized ingot to a hot rolling final thickness with a tandem mill and coiling at the hot rolling final thickness with a hot rolling exit temperature less than 300° C. to obtain a hot rolled sheet, cold rolling the hot rolled sheet to obtain a cold rolled sheet, the cold rolled sheet is further solution heat treated at a temperature of at least 460° C. and quenched in a continuous annealing line.

2. The method according to claim 1 wherein the Cu content is from 0.08 to 0.15 wt. %.

3. The method according to claim 1 wherein the hot rolled sheet obtained after finish hot rolling exhibits at most 50% recrystallization rate.

4. The method according to claim 1 wherein the homogenized ingot is cooled with a cooling rate in a range from 150° C./h to 2000° C./h directly to a hot rolling starting temperature, between 370° C. and 430° C.

5. The method according to claim 1 wherein the ingot thickness is at least 250 mm and wherein the ingot is from 1000 to 2000 mm in width and 2000 to 8000 mm in length and wherein a thermal differential of less than 40° C. over the entire ingot cooled from the homogenization temperature is obtained at the hot rolling starting temperature.

6. The method according to claim 1 wherein the coiling temperature after solution heat treatment is up to 85° C.

7. The method according to claim 1 wherein after solution heat treatment and quench the cold rolled sheet is aged to a T4 temper, cut and formed to final shape, painted and bake hardened.

8. The method according to claim 1, wherein no annealing is carried out during cold rolling.

9. The method according to claim 1, wherein the cold rolled sheet thickness is between 0.5 and 2 mm.

10. The method according to claim 1, wherein the cold rolling reduction is at least 50%.

11. The method according to claim 1, wherein the Si content is from 0.55 to 0.65 wt. %.

12. The method according to claim 1, wherein the cold rolled sheet is an automobile hood inner, wherein the cold rolled sheet has a roping value RK according to VDA Recommendation 239-400, July 2017 of less than 5 and a TYS (tensile yield strength) in the LT direction (long transverse direction) after bake hardening (2% stretching and 20 min at 185° C.), $TYS(LT)_{BH}$ (tensile yield strength in the LT direction after bake hardening) between 90 MPa and 150 MPa.

13. The 6xxx series aluminum cold rolled sheet made by the method of claim 7 having a roping value RK according to VDA Recommendation 239-400, July 2017 of less than 5 and a TYS (tensile yield strength) in the LT direction (long transverse direction) after bake hardening (2% stretching and 20 min at 185° C.), $TYS(LT)_{BH}$ (tensile yield strength in the LT direction after bake hardening) between 90 MPa and 150 MPa.

14. The cold rolled sheet according to claim 13 having a Si content between 0.55 wt. % and 0.60 wt. %, a Mg content is between 0.25 wt. % and 0.30 wt. %, a roping value RK according to VDA Recommendation 239-400, July 2017 of less than 5.0 and $TYS(LT)_{BH}$ between 90 MPa and 120 MPa.

15. The cold rolled sheet according to claim 13 having a Si content between 0.60 wt. % and 0.65 wt. %, a Mg content between 0.30 wt. % and 0.35 wt. %, a roping value RK according to VDA Recommendation 239-400, July 2017 of less than 5.0 and $TYS(LT)_{BH}$ between 120 MPa and 150 MPa.

16. A product comprising the 6xxx series aluminum cold rolled sheet according to claim 13, wherein the product is an automobile hood inner.

17. The cold rolled sheet according to claim 14, wherein the roping value RK according to VDA Recommendation 239-400, July 2017 is less than 4.0.

18. The method according to claim 1, wherein the continuous annealing line is operated in such a way that a temperature of between 540° C. and 560° C. is reached by the cold rolled sheet.

19. The method according to claim 6, wherein the coiling temperature after solution heat treatment is between 45° C. and 65° C.

20. The method according to claim 12, wherein no annealing is carried out during cold rolling.

* * * * *